United States Patent [19]

Richardson, Jr.

[11] Patent Number: 5,013,225

[45] Date of Patent: May 7, 1991

[54] LUBRICATION SYSTEM FOR A SCROLL COMPRESSOR

[75] Inventor: Hubert Richardson, Jr., Brooklyn, Mich.

[73] Assignee: Tecumseh Products Company, Tecumseh, Mich.

[21] Appl. No.: 400,785

[22] Filed: Aug. 30, 1989

[51] Int. Cl.[5] ..... F04C 18/04; F04C 29/02

[52] U.S. Cl. ..... 418/1; 418/55.6; 418/88; 418/94; 418/97; 418/DIG. 1

[58] Field of Search ..... 418/1, 55 E, 88, 94, 418/97, 99, DIG. 1, 55.6

[56] References Cited

U.S. PATENT DOCUMENTS

| | | | |
|---|---|---|---|
| 4,314,796 | 2/1982 | Terauchi | 418/57 |
| 4,457,675 | 7/1984 | Inagaki et al. | 418/14 |
| 4,496,296 | 1/1985 | Arai et al. | 418/57 |
| 4,555,224 | 11/1985 | Hazaki et al. | 418/88 |
| 4,596,520 | 6/1986 | Arata et al. | 418/57 |
| 4,669,962 | 6/1987 | Mizuno et al. | 418/57 |
| 4,696,630 | 9/1987 | Sakata et al. | 418/57 |
| 4,865,530 | 9/1989 | Nishida et al. | 418/55 E |

FOREIGN PATENT DOCUMENTS

| | | | |
|---|---|---|---|
| 58-170871 | 10/1983 | Japan | 418/99 |
| 58-170876 | 10/1983 | Japan | 418/97 |
| 59-185892 | 10/1984 | Japan | 418/55 E |

*Primary Examiner*—John J. Vrablik

*Attorney, Agent, or Firm*—Jeffers, Hoffman & Niewyk

[57] ABSTRACT

A hermetic scroll compressor is disclosed including within a hermetically sealed housing a fixed scroll member, an orbiting scroll member, and a crankshaft operably coupled to the orbiting scroll member and driven by a motor. The crankshaft has an axial passageway therein that is in fluid communication with an oil sump located in a discharged pressure chamber within the housing. Upon rotation of the crankshaft, a centrifugal oil pump delivers oil through the axial passageway to the bottom surface of a plate portion of the orbiting scroll member. An oil passage extends through the orbiting scroll plate to introduce oil into a discharge compression chamber established by the intermeshing fixed and orbiting scroll members. Accordingly, oil is introduced into the compression chamber and intermediate the scroll members without the creation of an intentional pressure leak. The size of the oil passage can be varied to affect the amount of oil introduced into the compression chamber.

17 Claims, 3 Drawing Sheets

LUBRICATION SYSTEM FOR A SCROLL COMPRESSOR

BACKGROUND OF THE INVENTION

The present invention relates generally to a hermetic compressor and, more particularly, to such a compressor including intermeshing fixed and orbiting scroll members within a housing having an oil sump, wherein oil from the sump is used to lubricate and to help seal the scroll members.

A typical scroll compressor comprises two mutually facing scroll members, each having an involute wrap, wherein the respective wraps interfit to define a plurality of compression pockets. When one of the scroll members is orbited relative to the other, the pockets travel in a radial direction, e.g., from a radially outer suction port to a radially inner discharge port, to convey and compress a refrigerant fluid.

Several design problems are associated with scroll-type compressors of the type described herein. For example, a proper seal must be maintained at the sliding interface between the wrap tips of one scroll member and the face surface of the opposite scroll member in order to minimize leakage between compression pockets of different pressure levels. Such leakage causes reduced compressor operating efficiency. Likewise, proper lubrication is necessary at the sliding interface between scroll members in order to minimize friction. Excessive friction results in heating of the scroll members and increased drive torque requirements, both of which reduce the operating efficiency of the compressor.

It is generally recognized that the presence of oil at the sliding interface between scroll members improves sealing and reduces friction. However, several problems and disadvantages are associated with prior art compressors and associated methods for providing such oil at the interface. For example, an intentional high to low pressure leak is often created in order to draw the oil into the interface. This intentional leak between suction and discharge pressure regions reduces compressor operating efficiency. Also, oil introduced at the interface often becomes entrained in the refrigerant that is subsequently supplied to the accompanying refrigeration system. If the oil rate, i.e., the percentage of oil present in the refrigerant, becomes too high, the efficiency of the refrigeration system diminishes.

The present invention is directed to overcoming the aforementioned problems associated with hermetic scroll compressors, wherein it is desired to provide oil at the interface between scroll members in order to enhance sealing and reduce friction.

SUMMARY OF THE INVENTION

The present invention overcomes the problems and disadvantages of the above-described prior art compressors by providing an improved compressor lubrication system, wherein oil is supplied directly from an oil sump at discharge pressure to a discharge portion of the compression interface between the fixed and orbiting scroll members, whereby efficient sealing and lubrication of the scroll members is accomplished.

Generally, the present invention provides a scroll compressor mechanism within a sealed housing having an oil sump therein at discharge pressure. Oil at discharge pressure from the oil sump is supplied to a discharge pressure portion of the compression interface between the fixed and orbiting scroll members of the scroll compressor mechanism. Because the sliding interface between the involute wrap tips of one scroll member and the plate portion of the other scroll member is inherently subject to leakage therealong from a discharge pressure portion to a suction pressure portion, oil introduced directly to the discharge pressure portion will travel along the sliding interface to provide improved lubrication and sealing.

More specifically, the present invention provides, in one form thereof, a scroll-type compressor mechanism within a hermetically sealed housing. The compressor mechanism includes fixed and orbiting scroll members operably intermeshed to define a compression interface therebetween. A drive mechanism including a rotatable crankshaft is operably coupled to the orbiting scroll member to impart orbiting motion thereto relative to the fixed scroll member. Accordingly, refrigeration fluid is compressed in the compression interface and is discharged into a discharge pressure space within the housing before exiting the housing. An oil sump is disposed within the discharge pressure space. A centrifugal oil pump is operable upon rotation of the crankshaft to pump oil from the oil sump to a discharge pressure portion of the compression interface by means of an axial oil passageway in the crankshaft and an oil port extending through the plate portion of the orbiting scroll member in uninterrupted fluid communication with the discharge pressure portion.

An advantage of the lubrication system of the present invention is that oil is supplied to the sliding interface between the fixed and orbiting scroll members without leakage losses, thereby improving compressor efficiency.

Another advantage of the lubrication system of the present invention, in accordance with one form, is that oil is introduced at an extreme radially inner location of the sliding interface between scroll member and travels outwardly, thereby lubricating substantially all of the interface.

A further advantage of the lubrication system of the present invention is that the sliding interface between the scroll members is lubricated without substantially affecting the oil rate of the accompanying refrigeration system.

Yet another advantage of the lubrication system of the present invention is that an uninterrupted flow of oil from the oil sump is supplied to the sliding interface between scroll members.

A still further advantage of the lubrication system of the present invention, according to one form thereof, is that the oil port in the orbiting scroll member may be selectively positioned and sized to achieve desired operational characteristics.

Another advantage of the lubrication system of the present invention is that a vent is provided for the axial oil passageway through the crankshaft, thereby ensuring flow of lubricating oil and preventing oil stack-up and its attendant problems.

The invention, in one form thereof, provides a scroll-type compressor for compressing refrigerant fluid, which includes a hermetically sealed housing including therein a discharge pressure chamber at discharge pressure and a suction pressure chamber at suction pressure. The compressor also includes an oil sump within the discharge pressure chamber, a suction inlet for conveying refrigerant fluid from outside the housing to the suction pressure chamber, and a discharge outlet for conveying refrigerant fluid from the discharge pressure chamber to outside the housing. A fixed scroll member and an orbiting scroll member each include a respective plate portion and a respective involute wrap element. The fixed and orbiting scroll members are operably intermeshed to define a compression interface therebetween wherein refrigerant fluid is compressed upon orbiting motion of the orbiting scroll member with respect to the fixed scroll member. A drive mechanism causes the orbiting scroll member to orbit with respect to the fixed scroll member. A discharge portion of the compression interface is in constant fluid communication with the discharge pressure chamber. Oil is pumped from the oil sump to the discharge portion of the compression interface while the oil remains at at least discharge pressure. In accordance with one aspect of the invention, oil is supplied from the oil sump to a radially inner portion of the compression interface by means of an oil port extending through the plate portion of the orbiting scroll member.

The invention further provides, in one form thereof, a method for lubricating the sliding interface between the fixed and orbiting scroll members of a scroll compressor, wherein the compressor includes a housing defining a discharge space. Within the housing, a scroll compressor mechanism has operably intermeshed fixed and orbiting scroll members defining a compression interface therebetween. A drive mechanism is operably coupled to the orbiting scroll member to impart orbiting motion thereto. The compressor also includes a suction inlet for introducing refrigerant fluid to a suction portion of the compression interface, and a discharge outlet for removing refrigerant fluid from the discharge space of the housing, wherein a discharge portion of the compression interface is in fluid communication with the discharge space of the housing. A step of the method includes providing an oil sump within the discharge space of the housing. Another step involves supplying oil from the oil sump to the discharge portion of the compression interface while the oil remains at at least discharge pressure.

In one aspect of the invention, in accordance with the aforementioned compressor or method forms thereof, a discharge conduit provides fluid communication between the discharge pressure space within the housing and the outside of the housing. The conduit has an open end within the discharge pressure space that is remote from where oil and refrigerant fluid is discharged from the compression interface into the discharge pressure space. Accordingly, refrigerant fluid and oil from the discharge pressure portion of the compression interface is first discharged into the discharge space of the housing at a location remote from the open end of the discharge conduit. Then, primarily refrigerant fluid is discharged outside the housing through the discharge conduit, therebY permitting most of the oil discharged from the compression interface to be returned to the oil sump.

DESCRIPTION OF THE PREFERRED EMBODIMENT

Figure 1:
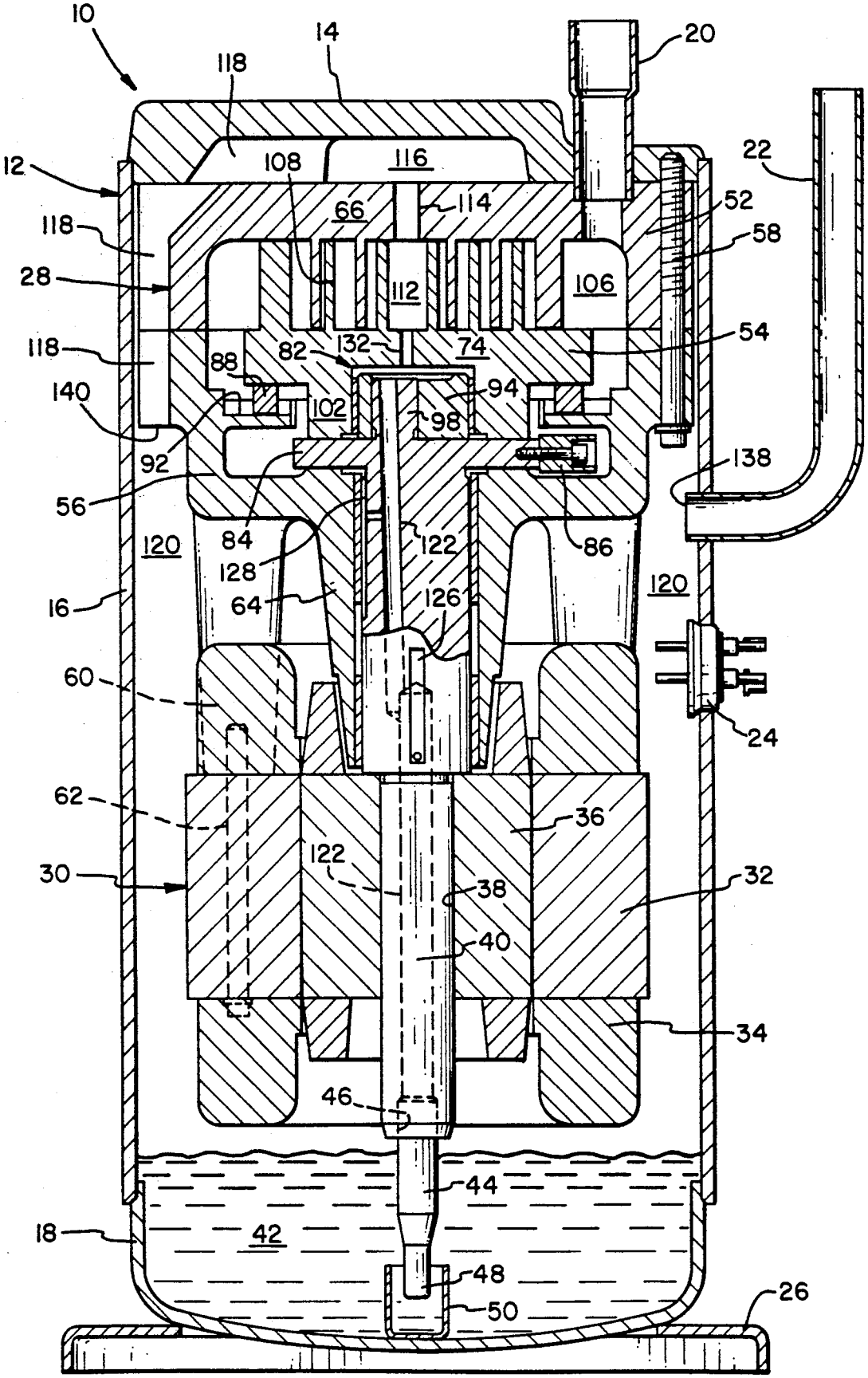
FIG. 1 is an elevational sectional view of a compressor of the type to which the present invention pertains.

Referring now to the drawings, there is shown a hermetic scroll-type compressor 10 of the type to which the present invention is applicable. Compressor 10 includes a housing 12 having a top cover plate 14, a central portion 16, and a bottom portion 18, all of which are hermetically joined, as by welding. Housing 12 includes a suction inlet 20, a discharge outlet 22, and an electrical terminal cluster 24. A mounting flange 26 is welded to bottom portion 18 for mounting the housing in a vertically upright position.

Disposed within housing 12 is a motor-compressor unit comprising a scroll compressor mechanism 28 and an electric motor 30. Motor 30 includes a stator 32 having windings 34, and a rotor 36 having a central aperture 38 into which a crankshaft 40 is secured by an interference fit. An oil sump 42 is provided generally in the bottom portion of housing 12. A centrifugal oil pickup tube 44 is press fit into a counterbore 46 in the lower end of crankshaft 40. Pick-up tube 44 is of conventional construction, and may optionally include a vertical paddle (not shown) enclosed therein. An oil inlet end 48 of pickup tube 44 extends downwardly into the open end of a cylindrical oil cup 50, which provides a quiet zone from which high quality, non-agitated oil may be drawn.

Compressor mechanism 28 generally comprises a fixed scroll member 52, an orbiting scroll member 54, and a frame member 56. As shown in FIG. 1, fixed scroll member 52 and frame member 56 are secured together and are attached to top cover plate 14 by means of a plurality of mounting bolts 58. Frame member 52 includes a plurality of mounting pads 60 to which motor stator 32 is attached by means of a plurality of mounting bolts 62, such that there is an annular gap between stator 32 and rotor 36. Frame member 52 also includes a bearing portion 64 in which crankshaft 40 is rotatably journalled.

Figure 2:
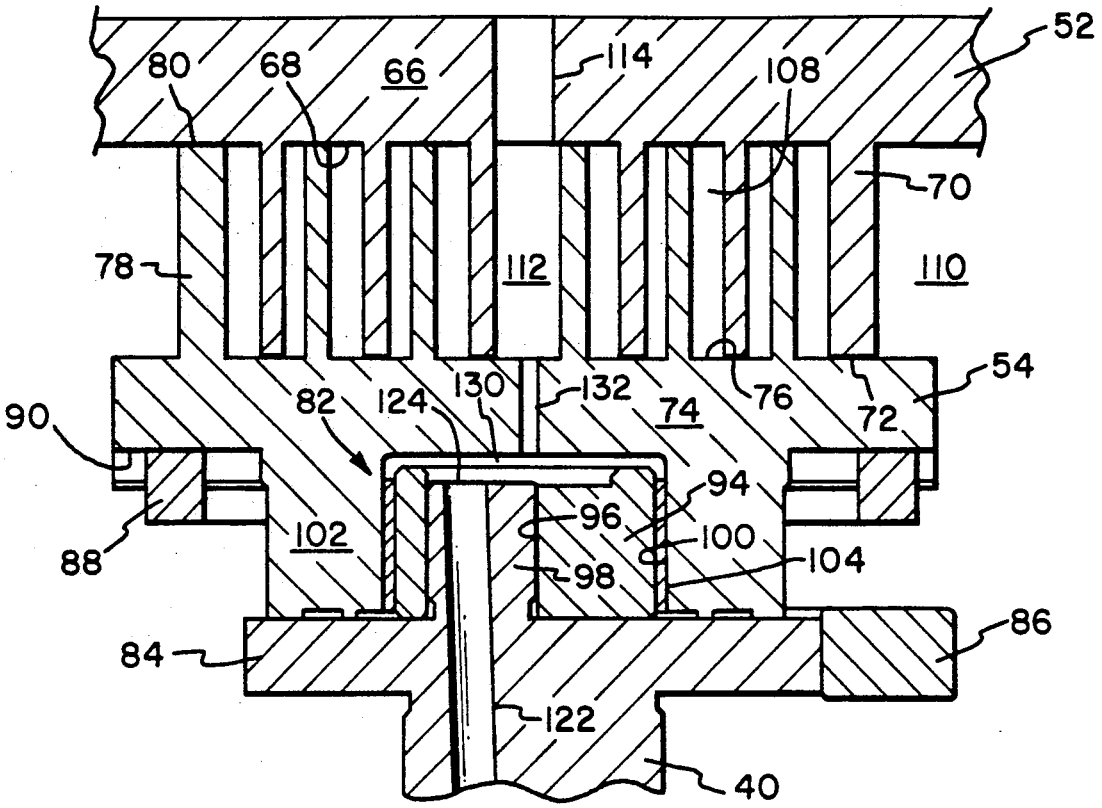
FIG. 2 is an enlarged fragmentary sectional view of the compressor of FIG. 1, particularly showing the orbiting scroll member and an oil port extending through the plate portion thereof.

Referring now to FIGS. 1 and 2, fixed scroll member 52 comprises a generally flat plate portion 66 having a face surface 68, and an involute fixed wrap 70 extending axially from surface 68 and having a wrap tip surface 72. Likewise, orbiting scroll member 54 comprises a generally flat plate portion 74 having a top face surface 76, and an involute orbiting wrap 78 extending axially from surface 74 and having a wrap tip surface 80. Fixed scroll member 52 and orbiting scroll member 54 are operably intermeshed such that wrap tip surfaces 72, 80 of wraps 70, 76 sealingly engage with respective opposite face surfaces 74, 68 along a respective sliding interface therebetween.

The upper end of crankshaft 40 includes a crank assembly 82, which drivingly engages the underside of orbiting scroll member 54. Crankshaft 40 also includes a thrust plate 84, intermediate orbiting scroll member 54 and frame member 56, to which is attached a counterweight 86. Orbiting scroll member 54 is prevented from rotating about its own axis by means of a conventional Oldham ring assembly, comprising an Oldham ring 88, and Oldham key pairs 90, 92 associated with orbiting scroll member 54 and frame member 56, respectively.

Referring more particularly to FIG. 2, crank assembly 82 comprises a cylindrical roller 94 having an eccentric axial bore 96 extending therethrough. An eccentric crankpin 98 on the upper end of crankshaft 40 is received within bore 96, whereby roller 94 is eccentrically journalled about eccentric crankpin 98. Roller 94 and crankpin 98 are received within a cylindrical well 100 defined by a lower hub portion 102 on the bottom of orbiting scroll member 54. Roller 94 is journalled for rotation within well 100 by means of a sleeve bearing 104, which is press fit into well 100.

In operation of compressor 10 -of the preferred embodiment, refrigerant fluid at suction pressure is introduced through suction inlet 20 into a suction pressure chamber 106 generally defined by fixed scroll member 52 and frame member 56. Operably intermeshed fixed and orbiting scroll members 52, 54 define a compression interface 108 therebetween, a radially outer portion 110 of which is in fluid communication with suction pressure chamber 106. As orbiting scroll member 54 is caused to orbit, refrigerant fluid is compressed radially inwardly from radially outer portion 110 to a radially inner portion 112 of compression interface 108, at which the compressed refrigerant fluid is at discharge pressure.

Refrigerant fluid at discharge pressure in radially inner portion 112 is discharged upwardly through a discharge port 114 communicating through plate portion 66 of fixed scroll member 52. The refrigerant discharged through discharge port 114 enters a discharge plenum chamber 116 defined by the underside of top cover plate 14, and then passes through a duct 118 into a discharge pressure space 120 defined within housing 12. It is important to note that oil sump 42 is disposed within discharge pressure space 120. Accordingly, radially inner portion 112 of compression interface 108 is in fluid communication with discharge pressure space 120 and oil sump 42 disposed therein.

Generally, compressor 10 includes a lubrication system which supplies oil from oil sump 42 to various locations in the compressor requiring lubrication, e.g., crankshaft bearings. More specifically, crankshaft 40 includes a generally axial oil passageway 122 extending from counterbore 46 on the lower end of the crankshaft to an opening 124 on the top of crankpin 98 at the upper end of the crankshaft. Upon rotation of crankshaft 40, oil pick-up tube 44 pumps oil through passageway 122 to flats 126, 128 at intermediate locations along the crankshaft, and out opening 124 to an oil chamber 130 defined by well 100 and the top of crank assembly 82. Oil within oil chamber 130 will tend to flow downwardly along the interface between bore 96 and crankpin 98 and the interface between roller 94 and well 100, for lubrication thereof.

The lubrication system of compressor 10, in accordance with one embodiment of the present invention, provides fluid communication between oil chamber 130 and radially inner portion 112 of compression interface 108 by means of an oil port 132 extending through plate portion 74 of orbiting scroll member 54. Accordingly, fluid communication is established between oil sump 42 at discharge pressure and radially inner portion 112 at discharge pressure, by means of oil pick-up tube 44, axial oil passageway 122, oil chamber 130, and oil port 132. The centrifugal pumping action of pick-up tube 44 pumps oil from sump 42 to inner portion 112 of compression interface 108.

Figure 4:
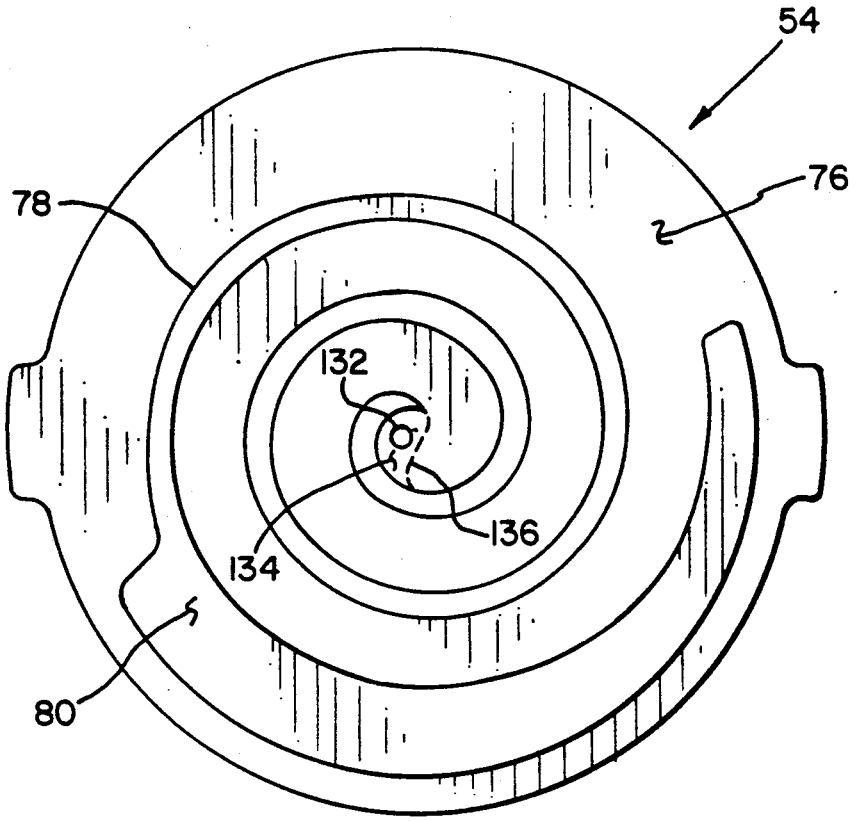
FIG. 4 is an enlarged top view of the orbiting scroll member of the compressor of FIG. 1, particularly showing the discharge port being locating within a region of the scroll member plate portion representing uninterrupted communication with the discharge port.
Figure 3:
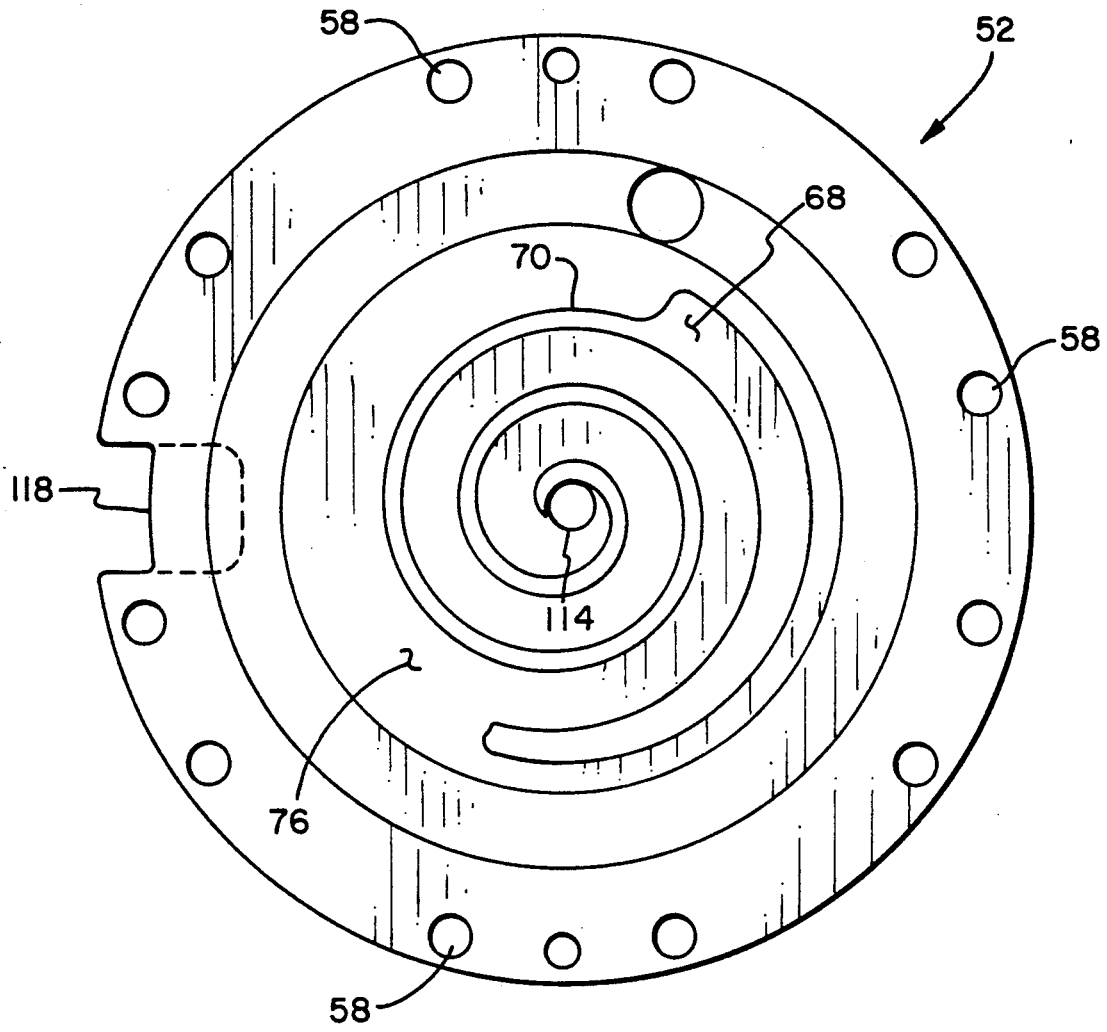
FIG. 3 is an enlarged bottom view of the fixed scroll member of the compressor of FIG. 1.

According to a preferred embodiment of the invention, oil port 132 is generally axially aligned with discharge port 114, and is located in plate portion 74 such that constant fluid communication is maintained with radially inner portion 112 and, hence, with discharge port 114. Referring to FIG. 4, it can be seen that oil port 132 is located within an area 134 bounded by the radially inner extreme of wrap 78 and a phantom line identified by reference numeral 136. Area 134 represents the area on face surface 76 of orbiting scroll member 54 that would not be covered by wrap tip surface 72 of fixed scroll member 52 during relative orbiting motion therebetween. This area will vary depending on the particular wrap tip geometry of the scroll members, and can be easily determined by mapping out the overlapping areas of the fixed wrap element and orbiting plate portion.

It will be appreciated that the sliding interfaces between respective wrap tip surfaces 72, 80 and face surfaces 74, 68 are subject to leakage of oil therealong from the radially inner portion of the compression interface to the radially outer portion thereof. Consequently, oil that is introduced into radially inner portion 112 of compression interface 108 travels radially outwardly due to orbiting motion of orbiting scroll member 54 and the aforementioned inherent leakage at the sliding interface. Also, the amount of oil introduced into radially inner portion 112 may be controlled by the relative sizing of discharge port 114 and oil port 132. It is suggested that discharge port 114 have a diameter of between 0.375 and 0.500 inches, and that oil port 132 have a diameter of between 0.060 and 0.120 inches.

Referring once again to FIG. 1, discharge outlet 22 comprises a cylindrical tube having an open end 138 on the interior of housing 12. Open end 138 is purposely positioned at a location remote from a duct opening 140 of duct 118, through which compressed refrigerant fluid is discharged into discharge pressure space 120. In the disclosed embodiment, open end 138 and duct opening 140 are diametrically opposite one another. According to this configuration, refrigerant fluid and oil that is discharged from duct opening !40 into discharge space 120 undergoes separation before primarily refrigerant fluid enters open end 138 and is discharged through discharge outlet 22, thereby permitting most of the oil to be returned to the oil sump. Therefore, it can be seen that improved lubrication and sealing of the fixed and orbiting scroll members is accomplished in the disclosed embodiment of the invention without increasing the oil circulation rate of the accompanying refrigeration system (not shown).

It will be appreciated that while the disclosed lubrication system for a scroll compressor has its primary advantage in supplying lubricating oil to the sliding interface between scroll members without introducing an intentional leak between regions of suction and discharge pressure, another significant advantage is realized in that a vent is provided for the axial oil passageway in the crankshaft, thereby maintaining flow of oil through the passageway and preventing overheating of the oil.

It will be appreciated that the foregoing description of a preferred embodiment of the invention is presented by way of illustration only and not by way of any limitation, and that various alternatives and modifications may be made to the illustrated embodiment without departing from the spirit an scope of the invention.

What is claimed is:

1. A scroll-type compressor for compressing refrigerant fluid, comprising:

a hermetically sealed housing including therein a discharge pressure chamber at discharge pressure and a suction pressure chamber at suction pressure;

an oil sump within said discharge pressure chamber;

suction inlet means for conveying refrigerant fluid from outside of said housing to said suction pressure chamber;

discharge outlet means for conveying refrigerant fluid from said discharge pressure chamber to outside said housing;

a fixed scroll member and an orbiting scroll member, each including a respective plate portion and a respective involute wrap element, said fixed and orbiting scroll members being operably intermeshed to define a compression interface therebetween wherein refrigerant fluid is compressed upon orbiting motion of said orbiting scroll member with respect to said fixed scroll member, a discharge portion of said compression interface being in constant fluid communication with said discharge pressure chamber through a discharge port;

drive means for causing said orbiting scroll member to orbit with respect to said fixed scroll member, said drive means including a rotatable crankshaft; and centrifugal pumping means operable upon rotation of said crankshaft for pumping oil from oil sump directly to said discharge portion of said compression interface while the oil remains at at least discharge pressure.

2. The scroll-type compressor of claim 1 in which:

said centrifugal pumping means provides a substantially constant flow of oil from said oil sump to said discharge portion of said compression interface during compressor operation.

3. The scroll-type compressor of claim 1 in which:

said centrifugal pumping means comprises a first generally axial oil passageway in said crankshaft and an oil port extending through said plate portion of said orbiting scroll member.

4. The scroll-type compressor of claim 3 in which:

said oil port extending through said plate portion of said orbiting scroll member provides uninterrupted fluid communication between said axial oil passageway in said crankshaft and said discharge portion of said compression interface.

5. A scroll-type compressor for compressing refrigerant fluid, comprising:

a hermetically sealed housing including therein a discharge pressure chamber at discharge pressure and a suction pressure chamber at suction pressure;

an oil sump within said discharge pressure chamber;

suction inlet means for conveying refrigerant fluid from outside of said housing to said suction pressure chamber;

discharge outlet means for conveying refrigerant fluid from said discharge pressure chamber to outside said housing;

a fixed scroll member and an orbiting scroll member, each including a respective plate portion and a respective involute wrap element, said fixed and orbiting scroll members being operably intermeshed to define a compression interface therebetween, a radially outer portion of said interface being in fluid communication with said suction pressure chamber and a radially inner portion of said interface being in constant fluid communication with said discharge pressure chamber;

drive means for causing said orbiting scroll member to orbit with respect to said fixed scroll member such that refrigerant fluid entering said radially outer portion is compressed and subsequently discharged at said radially inner portion, said drive means including a rotatable crankshaft operably coupled to said orbiting scroll member; and lubrication means of supplying oil from said oil sump to said radially inner portion of said compression interface, said lubrication means including an oil port extending through said plate portion of said orbiting scroll member and being in constant fluid communication with said radially inner portion, and centrifugal oil pumping means operable upon rotation of said crankshaft for pumping oil from said oil sump to said radially inner portion through said oil port, whereby said oil pumped by said centrifugal oil pumping means remains at at least discharge pressure.

6. The scroll-type compressor of claim 5 in which:

said plate portion of said fixed scroll member includes a discharge port extending therethrough, said discharge port providing said constant fluid communication between said radially inner portion of said compression interface and said discharge pressure chamber.

7. The scroll-type compressor of claim 6 in which:

said discharge outlet means comprises a discharge conduit providing fluid communication between said discharge pressure chamber and outside said housing, said conduit having an open end within said discharge pressure chamber remote from said discharge port, whereby refrigerant fluid and oil from said radially inner portion of said compression interface are discharged into said discharge pressure chamber within said housing prior to being discharge outside said housing through said discharge conduit, thereby permitting oil discharged from said radially inner portion to be returned to said oil sump.

8. The scroll-type compressor of claim 5 in which:

said lubrication means comprises an axial oil passageway extending through said crankshaft and providing fluid communication between said oil sump and said oil port.

9. The scroll-type compressor of claim 8 and further comprising:

means for providing fluid communication between said axial oil passageway in said crankshaft and said oil port in said orbiting scroll member, said means comprising a substantially closed fluid chamber defined by said orbiting scroll member and said crankshaft, said axial oil passageway and said oil port being in fluid communication with said fluid chamber.

10. The scroll-type compressor of claim 9 in which:

said crankshaft includes a drive end portion and said orbiting scroll member includes a drive hub portion defining a well in which said drive end portion is rotatably journalled, said well portion and said drive end portion defining said fluid chamber, and said axial oil passageway having an opening on an end surface of said end portion and said oil port having an opening on a bottom surface of said well.

11. The scroll-type compressor of claim 5 in which:
said plate portion of said orbiting scroll member includes a top surface adjacent said compression interface and a bottom surface, said oil port providing fluid communication between said top surface and said bottom surface; and
said rotatable crankshaft includes a lower pump end disposed within said oil sump, an upper delivery end adjacent said bottom surface, and an axial oil passageway extending through said crankshaft from said lower pump end to said upper delivery end, said lower pump end including a centrifugal oil pump forming a portion of said centrifugal oil pumping means and being operable upon rotation of said crankshaft to pump oil from said oil sump to said radially inner portion of said compression interface through said axial oil passageway and said port.

12. The scroll-type compressor of claim 11 in which:
said plate portion of said fixed scroll member includes a discharge port extending therethrough that provides said constant fluid communication between said radially inner portion of said compression interface and said discharge pressure chamber.

13. The scroll-type compressor of claim 5 in which:
said respective wrap elements of said fixed scroll member and said orbiting scroll member include an axially facing wrap tip surface, and said respective plate portions include an axially facing face surface, said fixed scroll member and said orbiting scroll member being operably intermeshed such that a respective sliding interface is established between the wrap tip surface of one scroll member and the face surface of the opposite scroll member, whereby each said sliding interface is subject to leakage of oil therealong from said radially inner portion of said compression interface to said radially outer portion, thereby providing enhanced lubrication and sealing along said respective sliding interfaces.

14. In a hermetic scroll-type compressor including a housing defining a discharge space, a scroll compressor mechanism having operably intermeshed fixed and orbiting scroll members to define a compression interface therebetween, drive means including a rotatable crankshaft operably coupled to the orbiting scroll member to impart orbiting motion thereto, a suction inlet for introducing refrigerant fluid to a suction portion of the compression interface, and a discharge outlet for removing refrigerant fluid from the discharge space of the housing, wherein a discharge portion of the compression interface is in constant fluid communication with the discharge space of the housing, a method for lubricating the intermeshed fixed and orbiting scroll members at their sliding interface, comprising the steps of:
providing an oil sump within the discharge space of the housing; and
supplying oil directly from said oil sump to the discharge portion of the compression interface while the oil remains at at least discharge pressure, by means of a centrifugal pump associated with said crankshaft and operable upon rotation of said crankshaft.

15. The method of claim 14 in which a substantially uninterrupted flow of oil is supplied from said oil sump to the discharge portion of the compression interface during compressor operation.

16. The method of claim 14, wherein the crankshaft has a generally axial oil passageway extending therethrough, and the orbiting scroll member includes a plate portion having an involute wrap thereon, in which:
said step of supplying oil directly from said oil sump to the discharge portion of the compression interface is performed by pumping oil through the axial oil passageway in the crankshaft and through an oil port extending through the plate portion of the orbiting scroll member, said oil port being in uninterrupted fluid communication with the discharge portion of the compression interface.

17. The method of claim 19, wherein the discharge outlet includes a discharge conduit having an open end within the discharge space of the housing to provide fluid communication between the discharge space and outside the housing, and further comprising the step of:
first discharging refrigerant fluid and oil from the discharge portion of the compression interface into the discharge space of the housing at a location remote from the open end of the discharge conduit, and then discharging primarily refrigerant fluid outside the housing through the discharge conduit, thereby permitting most of the oil discharged from the discharge portion of the compression interface to be returned to the oil sump.

* * * * *